US008152138B2

(12) United States Patent
Skillern

(10) Patent No.: US 8,152,138 B2
(45) Date of Patent: Apr. 10, 2012

(54) SELF-SEALING BITE VALVE

(75) Inventor: Jeff Skillern, Boise, ID (US)

(73) Assignee: OAKLEY, Inc., Foothill Ranch, CA (US)

( * ) Notice: Subject to any disclaimer, the term of this patent is extended or adjusted under 35 U.S.C. 154(b) by 496 days.

(21) Appl. No.: 12/322,995

(22) Filed: Feb. 9, 2009

(65) Prior Publication Data

US 2009/0302261 A1 Dec. 10, 2009

(51) Int. Cl.
*F16K 31/00* (2006.01)

(52) U.S. Cl. ..... 251/342; 251/354

(58) Field of Classification Search ..... 251/341, 251/342, 343, 349, 354; 222/175; 220/714; 224/148.2

See application file for complete search history.

(56) References Cited

U.S. PATENT DOCUMENTS

| | | | | | |
|---|---|---|---|---|---|
| 2,803,251 | A | * | 8/1957 | White | 215/11.4 |
| 3,087,656 | A | * | 4/1963 | Dougherty | 222/518 |
| 3,309,890 | A | | 3/1967 | Barnett et al. | |
| 3,677,443 | A | | 7/1972 | Smadar et al. | |
| 4,420,097 | A | | 12/1983 | Motsenbocker | |
| 4,629,098 | A | | 12/1986 | Eger | |
| 4,998,415 | A | | 3/1991 | Larsen | |
| 5,062,591 | A | | 11/1991 | Runkel | |
| 5,282,557 | A | | 2/1994 | McCook | |
| 5,447,039 | A | | 9/1995 | Allison | |
| 5,699,933 | A | * | 12/1997 | Ho et al. | 220/703 |
| 5,816,457 | A | * | 10/1998 | Croft | 224/148.2 |
| 5,911,406 | A | * | 6/1999 | Winefordner et al. | 251/339 |
| 5,913,456 | A | | 6/1999 | Dikeman | |
| 5,924,678 | A | * | 7/1999 | Olde | 251/348 |
| 5,940,880 | A | | 8/1999 | Phillips | |
| 5,971,357 | A | * | 10/1999 | Denton et al. | 251/144 |
| 6,039,305 | A | * | 3/2000 | Hoskins et al. | 251/342 |
| 6,581,538 | B2 | | 6/2003 | Sorensen | |
| 6,622,988 | B2 | * | 9/2003 | Gill | 251/351 |
| 6,886,807 | B1 | * | 5/2005 | Gill | 251/342 |
| 2002/0166493 | A1 | | 11/2002 | Sorensen | |
| 2005/0164538 | A1 | * | 7/2005 | Tiberghien et al. | 439/289 |
| 2006/0144862 | A1 | | 7/2006 | Reichert et al. | |
| 2006/0144863 | A1 | | 7/2006 | Reichert et al. | |
| 2007/0164037 | A1 | * | 7/2007 | Chen | 220/703 |
| 2008/0029561 | A1 | | 2/2008 | Reichert et al. | |
| 2008/0308032 | A1 | | 12/2008 | Skillern | |
| 2008/0308578 | A1 | | 12/2008 | Skillern et al. | |
| 2009/0140005 | A1 | | 6/2009 | Reichert et al. | |
| 2009/0179046 | A1 | | 7/2009 | Reichert et al. | |

(Continued)

OTHER PUBLICATIONS

U.S. Appl. No. 60/987,741 and cover sheet, filed on Nov. 13, 2007 by Reichert et al., entitled "Pressurized Fluid Delivery System With Filter and Associated Method," in 24 pages.

(Continued)

*Primary Examiner* — John Bastianelli

(74) *Attorney, Agent, or Firm* — Knobbe Martens Olson & Bear LLP

(57) ABSTRACT

A bite valve for a hydration system includes a body, a sheath, a seal post, a first seal, and a second seal. The body includes a body channel configured to flow a fluid. The sheath is configured to attach to the body. The sheath includes a sheath channel extending from the body to a sheath opening. The seal post is positioned within the sheath channel and is configured to be movable with respect to the sheath and the body between a sealed position and an unsealed position.

17 Claims, 8 Drawing Sheets

U.S. PATENT DOCUMENTS

2010/0044396 A1 2/2010 Skillern

OTHER PUBLICATIONS

U.S. Appl. No. 11/764,620, filed Jun. 18, 2007, published as 2008-0308578 on Dec. 18, 2008, including its ongoing prosectuion history, including office communications dated Sep. 1, 2009 and Mar. 18, 2010.

U.S. Appl. No. 12/191,254, filed Aug. 13, 2008, published as 2008-0308032 on Dec. 18, 2008, including its ongoing prosection history, including office communications dated Dec. 29, 2009 and Jul. 1, 2010.

U.S. Appl. No. 12/204,326, filed Sep. 4, 2008, published as 2010-0044396 on Feb. 25, 2010, including its ongoing prosectuion history.

International Search Report of Oct. 1, 2009 in International Application No. PCT/US2009/053784 filed on Aug. 13, 2009 from the International Searching Authority 8 pages.

* cited by examiner

SELF-SEALING BITE VALVE

BACKGROUND

A conventional bite valve has a resilient sheath and a main body. The sheath has an opening on one end through which liquid passing through the main body can be expelled. The other end of the sheath is affixed to the main body. Within the sheath is a seal rod and a biasing member such as a compression spring. The biasing member supplies a force that urges the end of the seal rod into the opening of the sheath. That end of the seal rod is shaped to fill that opening and provide a seal that helps prevent liquid from escaping through the bite valve. The seal rod is configured so that when a user bites down on the sheath, the sheath compresses into the seal rod forcing the seal rod into the main body. Sufficient bite pressure overcomes the biasing member. This causes the end of the seal rod to disengage from the sheath's opening, thus allowing liquid to pass through the main body and out the opening. US Pub. 2007/0164037 to Chen describes such a conventional bite valve.

When such a bite valve is coupled to a pressurized source, maintaining a proper seal is desirable. Through use and time, the sheath's opening can deform resulting in a poor or inoperative seal allowing undesired leaking.

DESCRIPTION OF THE DRAWINGS

In FIG. 1, the bite valve is in a closed position. In FIG. 2, the bite valve is in an open position.

FIG. 4 is a photo view of view showing the seal post inserted through the collar. FIG. 5 is a photo view showing the o-ring placed on the seal post. FIG. 6 is a photo view showing the biasing member coupled to the seal post. FIG. 7 is a photo view showing the seal post, collar, o-ring, and biasing member assembly inserted in the bite valve body according to an embodiment. In FIG. 7, the biasing member is urging the seal post out of the bite valve main body, thus closing the bite valve according to an embodiment. In FIG. 8, the seal post is being urged back into the body overcoming the biasing member to open the bite valve according to an embodiment.

DETAILED DESCRIPTION

It is desirable, especially when coupled to a pressurized source, that a bite valve maintain a proper seal when closed. Otherwise liquid from the pressurized source could leak from the valve. Various embodiments of the present invention assist in maintaining a proper seal in a bite valve even when that bite valve is coupled to a pressurized source. An example of a pressurized source is described in co-pending U.S. application Ser. No. 11/764,620 entitled "Pressurized Hydration System." Application Ser. No. 11/764,620 is hereby incorporated by reference.

Figure 1:
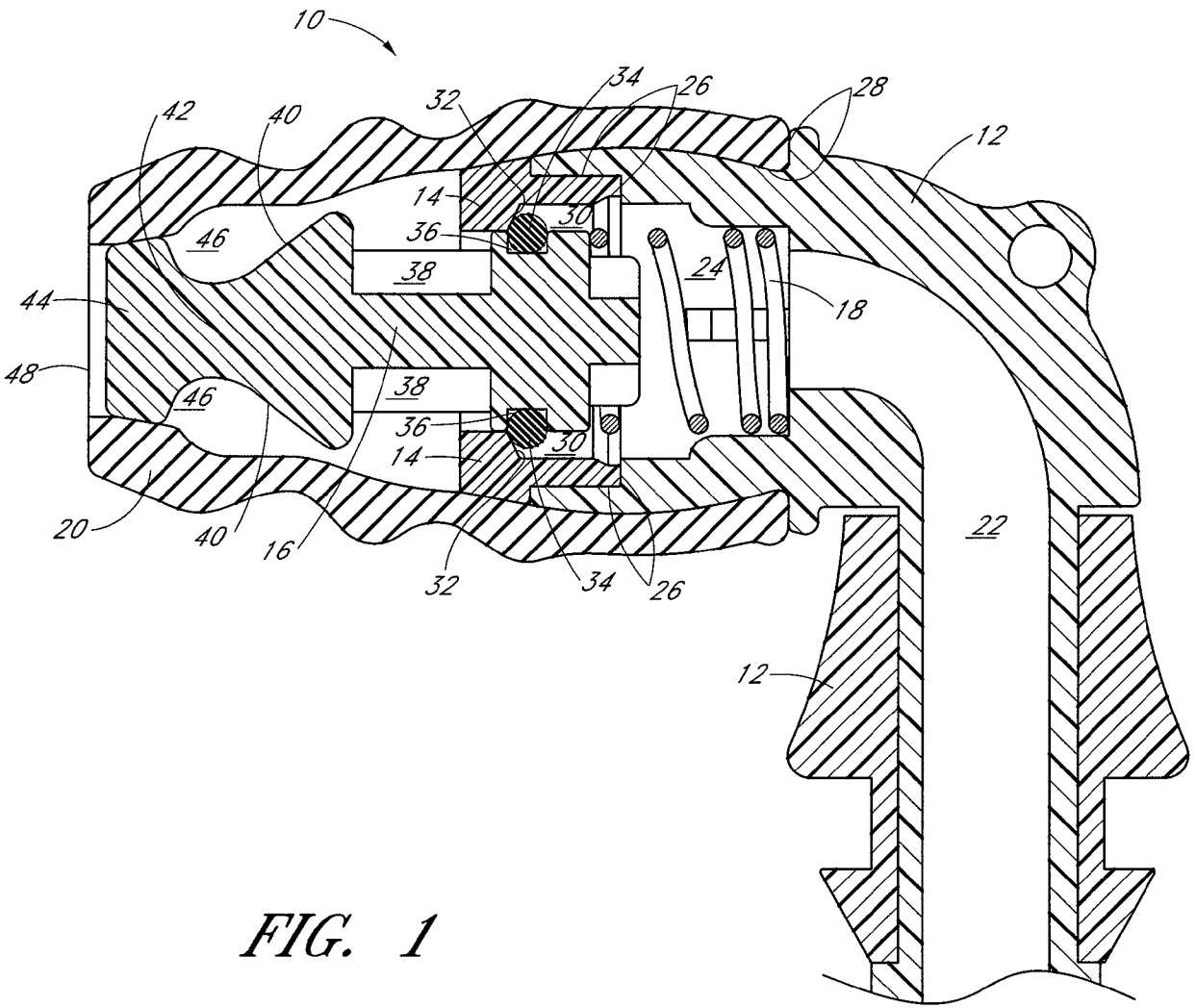
FIGS. 1 and 2 are cross-sectional views of an exemplary bite valve according to an embodiment.

FIGS. 1-8 illustrate an exemplary bite valve 10. As shown, bite valve 10 includes body 12, collar 14, seal post 16, biasing member 18, and sheath 20. Body 12 represents generally any structure through which fluid can flow. Referring to FIG. 1, body 12 includes body flow channel 22, biasing member cavity 24, collar support 26, and sheath support 28. Body flow channel 22 is a passageway though which a fluid can pass through body 12. While not shown, body 12 can be coupled to a fluid reservoir via a drinking tube. In a manner discussed in more detail below, fluid can pass from that reservoir through that drinking tube passing through body flow channel 22.

Biasing member cavity 24 represents a portion of the interior surface of body 12 within body flow channel 22 that is configured to hold or otherwise contain and support biasing member 18. Collar support 26 represents a portion of the interior surface of body 12 to which collar 14 can be affixed, removably or otherwise. Sheath support 28 represents a portion of the exterior surface of body 12 to which sheath 20 can be affixed, removably or otherwise.

Collar 14 represents generally any structure configured to be affixed to collar support 24 of body 12 while allowing fluid to flow through body flow channel 22. Collar 14 includes collar flow channel 30 and seal lip 32. Collar flow channel 30 represents a passage through which fluid can flow through collar 14 with collar 14 affixed to body 12. Seal lip 32 represents an interior surface of collar 14 within collar flow channel 30 that is against which a sealing component such as an o-ring can be pressed to impede the flow of fluid through body flow channel 22.

Seal post 16 represents generally any structure slideable between an extended position (FIG. 1) and an inserted position (FIG. 2) through collar flow channel 30 of collar 14. Seal post 16 includes o-ring 34, o-ring groove 36, and valve post flow channels 38. O-ring 34 represents generally any pliable material that can fit around seal post 16 increasing a diameter of seal post 16 at a given point. O-ring groove 36 defines the point at which o-ring 34 fits around seal post 16. Seal post channels 38 represent passageways formed when seal post 16 is inserted through collar 14. Fluid is allowed to flow through body flow channel 22, collar flow channel 30 and these passageways 38 when seal post is slid into the inserted position of FIG. 2. When in the extended position of FIG. 1, o-ring 34 of seal post 16 is pressed against seal lip 34 of collar 14 impeding the fluid flow. In this example, fluid is blocked from passing through collar flow channel 30 and into seal post channels 38 when seal post is extended as shown in FIG. 1. When seal post is slid to the inserted position shown in FIG. 2, fluid is allowed to pass through collar flow channel 30 and into seal post channels 38.

Figure 2:
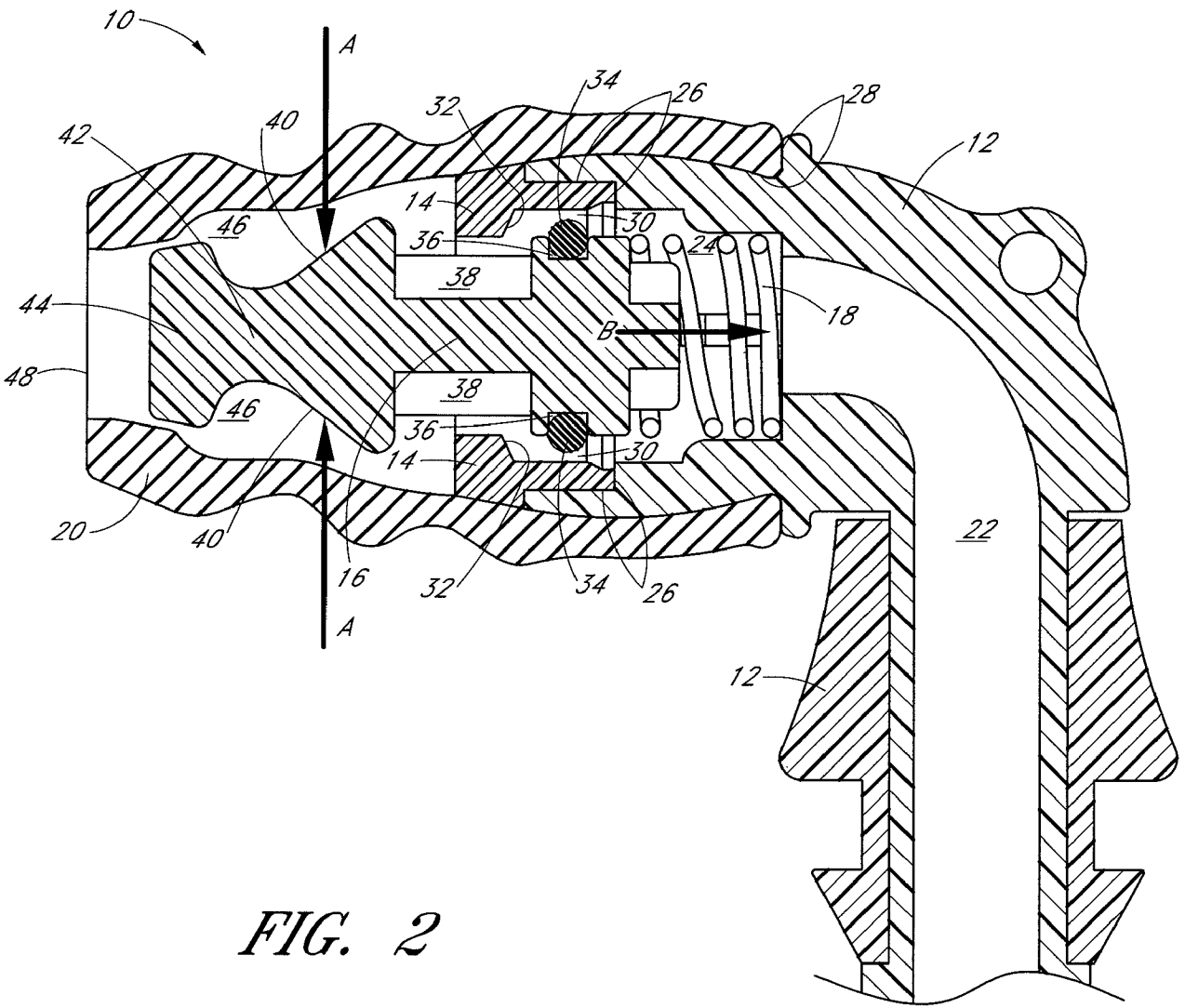

Biasing member 18 represents generally any structure configured to apply a biasing force on seal post 16 to keep seal post 16 in the extended position shown in FIG. 1. Biasing member 18, in this example, is a compression spring configured to fit within biasing cavity 24. One end of biasing member 18 is supported by biasing member cavity 24. The other end of biasing member 24 presses against the end of seal post 16 that is inserted through collar 14. The biasing force of biasing member 18 is overcome by sliding seal post 16 through collar 14 and further into body 12—that is—by compressing biasing member 18 as shown in FIG. 2. When the force needed to compress biasing member 18 is removed, biasing member forces seal post to the extended position shown in FIG. 1. The compression of o-ring 34 against seal lip 32 stops seal post 16 from being extended further and closes or seals bite valve 10.

Seal post 16 is also shown to include seal post incline 40, seal post neck 42, and seal post tip 44. Seal post incline 40 represents an inclined surface of seal post 40. The incline is noticeable with respect to a longitudinal axis of seal post 16, the longitudinal axis being an axis of seal post 16 that is parallel to the direction seal post 16 slides through collar 14. Seal post neck 42 represents a portion of seal post 16 at the point where seal post incline has its smallest diameter. Valve post tip 44 extends from seal post neck 42 with a larger diameter. Valve post tip is configured to generally seal an opening in sheath 20 when seal post 16 is in the extended position of FIG. 1.

Sheath 20 represents generally any pliable material such as silicone configured to fit around seal post 16 and couple to sheath support 28 of body 12. Sheath 20 includes sheath flow channel 46 and sheath opening 48. Sheath flow channel represents a passageway through which fluid passes out of bite valve 10 through sheath opening 48. With seal post 16 forced into the inserted position of FIG. 2, fluid can pass through bite valve 10 via body flow channel 22, collar flow channel 30, seal post flow channels 38, sheath flow channel 46 and sheath opening 48.

Referring to FIG. 2, to overcome the biasing force of biasing member 18, one bites down on sheath 20. The pressure from the bite compresses sheath 20 against valve post incline 40. The inclined surface of valve post incline 40 translates the pressure of the bite causing valve post 16 to slide into body 12 compressing biasing member 18 and opening bite valve 10. If attached to a pressurized liquid source, liquid from that source is forced through bite valve 10 and into the mouth of the person biting sheath 20. Once the person stops biting, biasing member 18 urges seal post back to the extended position closing bite valve 10. When coupled to a pressurized source, the force from the pressurization supplements the biasing force of biasing member 18 further improving the seal between o-ring 34 and seal lip 32.

Figure 3:
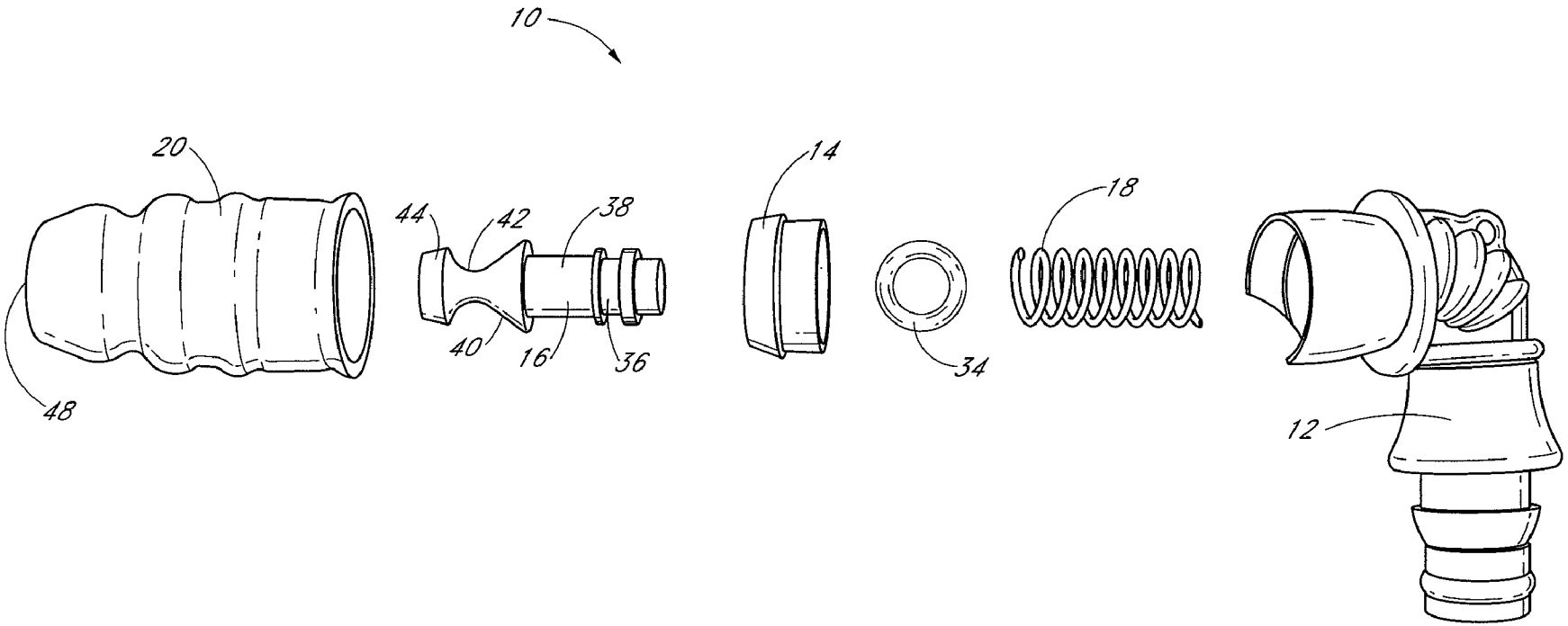
FIG. 3 is a photo view of a deconstructed bite valve according to an embodiment.
Figure 4:
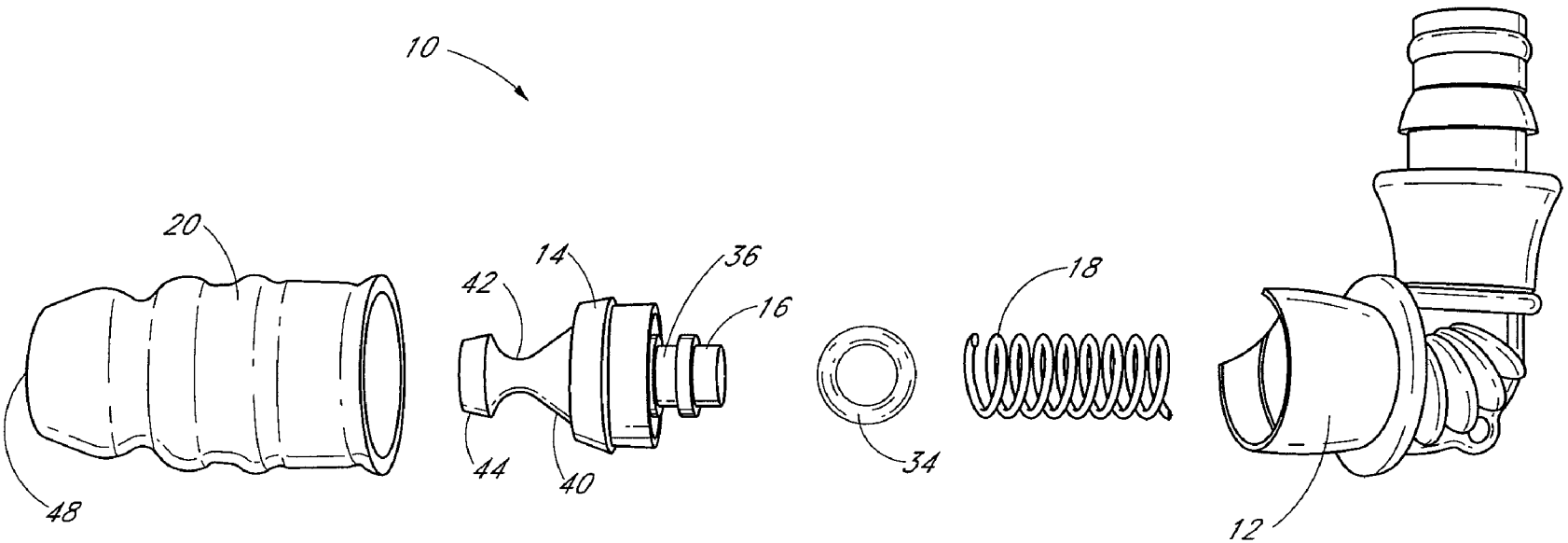
FIGS. 4-8 show a reconstruction of the bite valve according to an embodiment.
Figure 5:
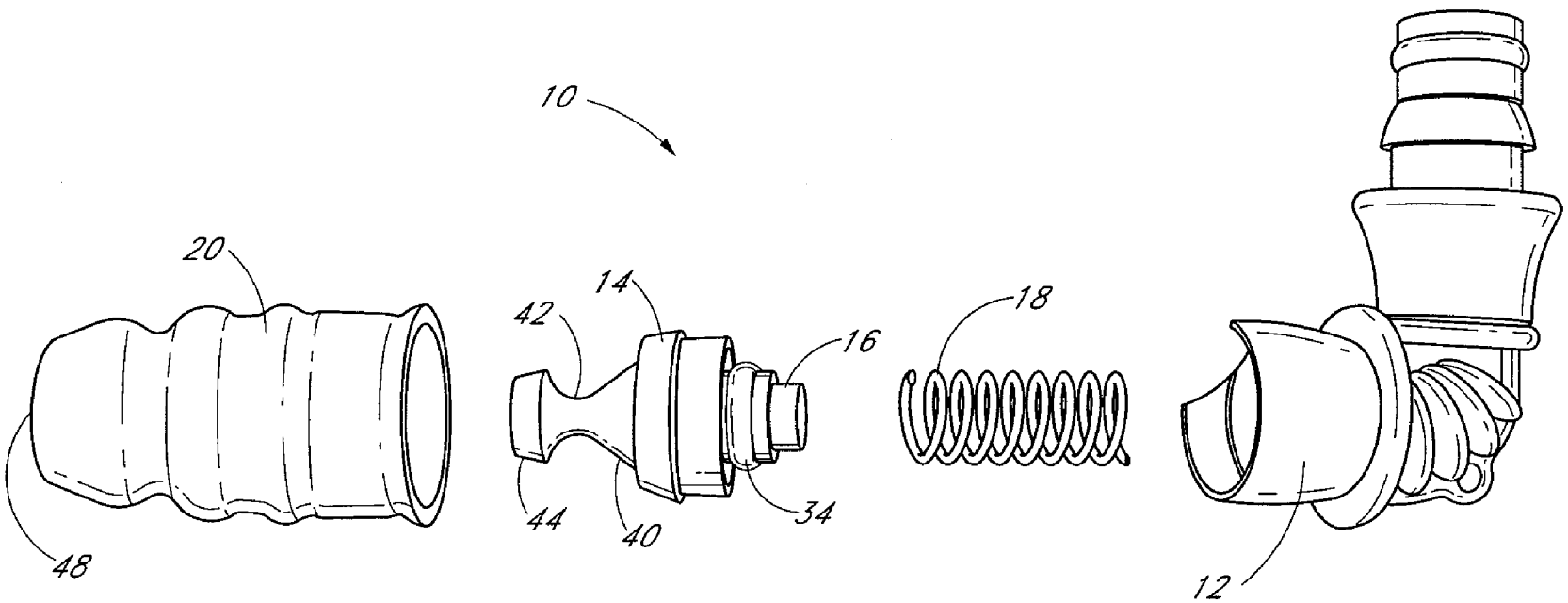
Figure 6:
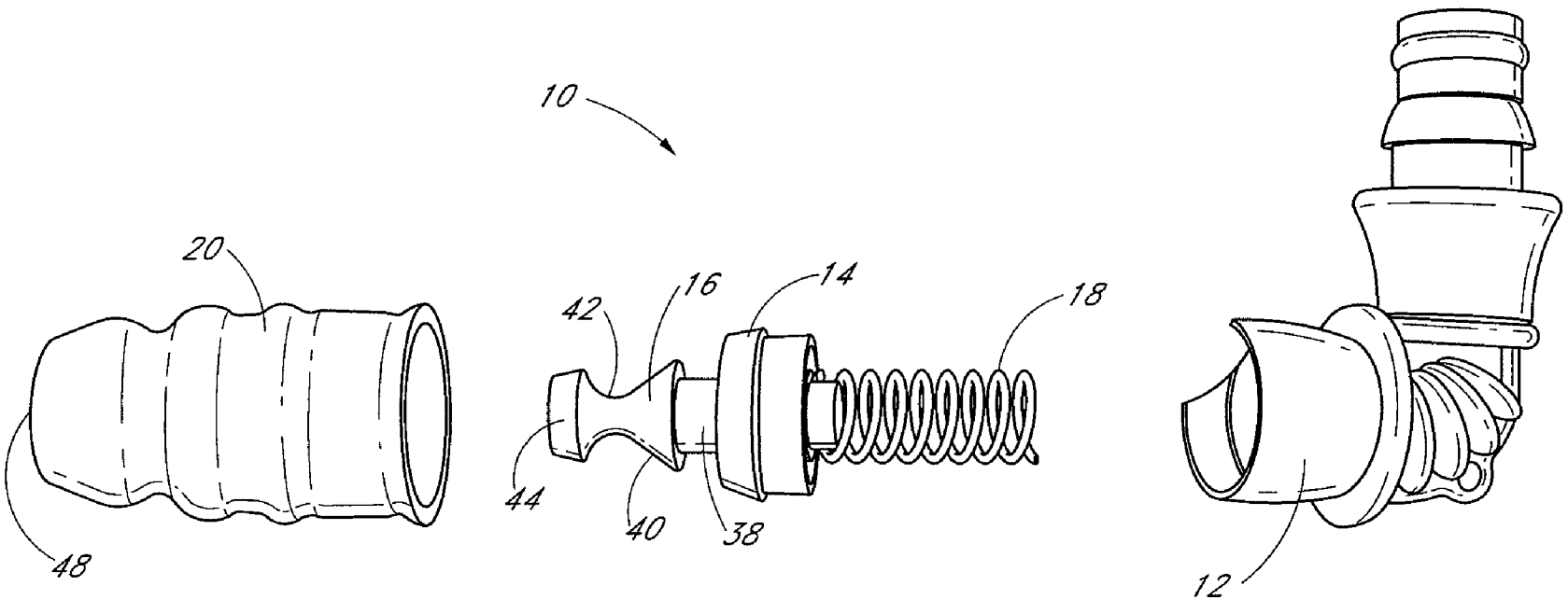
Figure 7:
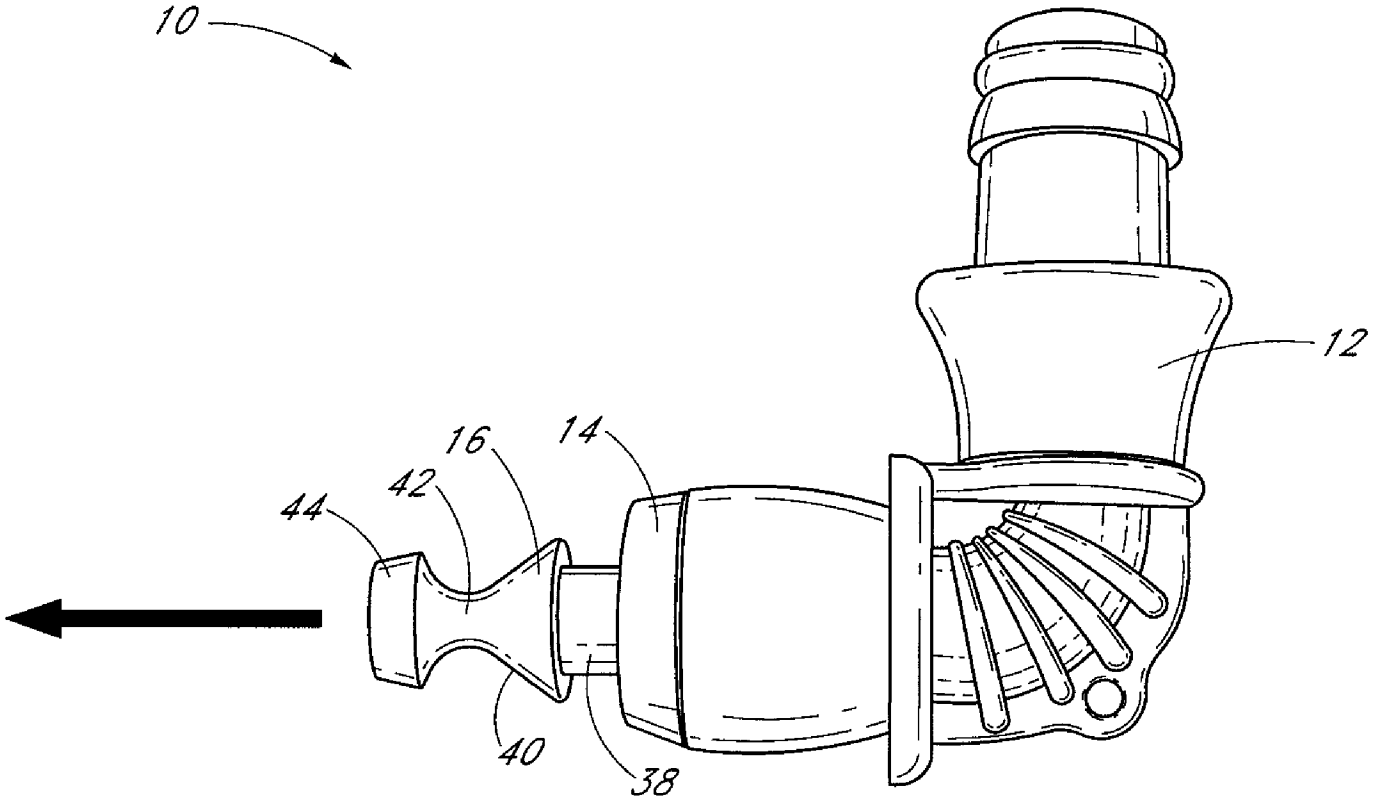
Figure 8:
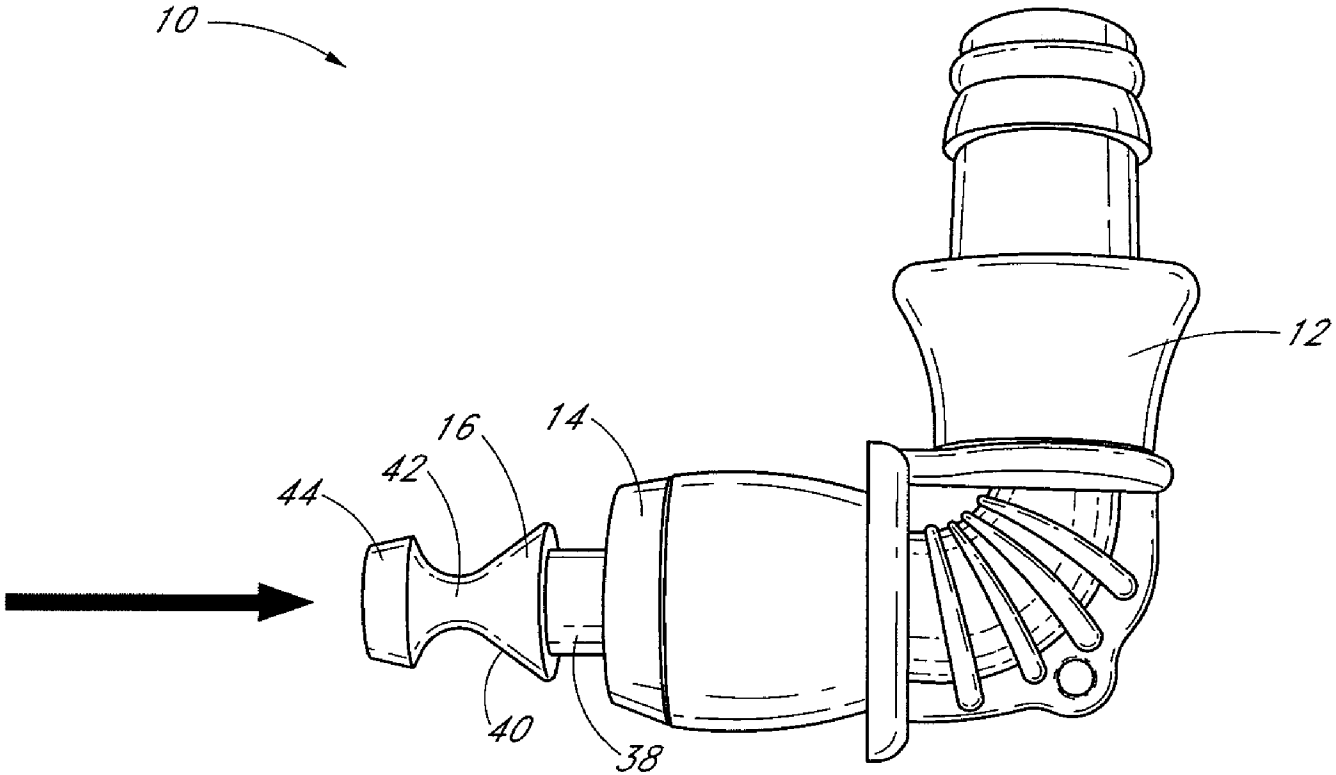

FIGS. 3-8 illustrate the assembly of bite valve 10. In FIG. 3, bite valve 10 is separated into its various components, body 12, biasing member 18, o-ring 34, collar 14, seal post 16, and sheath 20. In FIG. 4, seal post 16 has been inserted through collar 14. In FIG. 5, o-ring 34 has be placed in o-ring groove 36 (see FIGS. 1 and 2) of seal post 16. In FIG. 6, one end of biasing member 18 has been coupled to the end of seal post 16 that was inserted through collar 14. In FIG. 7, the assembly of seal post 16, collar 14, and biasing member 18 is partially inserted in and coupled to body 12. While not visible, biasing member is fit into biasing member cavity 24 of body 12 and collar 14 is affixed to collar support 26 of body 12. In FIG. 7, biasing member 18 is holding seal post 16 in the extended position closing bite valve 10. In FIG. 8, seal post is being slid into the inserted position opening bite valve 10. While not shown, sheath 20 can then be placed around seal post 16 and coupled to body 12 completing the assembly of bite valve 10

The various examples discussed above provide for a bite valve with an improved sealing capability. When coupled to a pressurized source, the force from the pressurization acts to further improve that seal.

The invention claimed is:

1. A bite valve for a hydration system, comprising:

a body comprising a body channel configured to flow a fluid;

a sheath configured to attach to the body, the sheath comprising a sheath channel extending from the body to a sheath opening;

a seal post positioned within the sheath channel and configured to be movable with respect to the sheath and the body between a sealed position and an unsealed position, wherein the seal post comprises an inclined surface configured such that an approximately transverse force applied against the inclined surface causes the seal post to move from the sealed position to the unsealed position; and a first seal and a second seal, wherein the first seal is configured to selectively restrict and allow fluid flow from the sheath channel through the sheath opening, and the second seal is configured to selectively restrict and allow fluid flow between the body channel and the sheath channel, and wherein the inclined surface is positioned between the first and the second seal; wherein the first seal and the second seal are configured to restrict fluid flow between the body channel and the sheath opening when the seal post is in the sealed position, and to allow fluid flow between the body channel, the sheath channel, and through the sheath opening, when the seal post is in the unsealed position.

2. The bite valve of claim 1, wherein the seal post comprises a seal post tip, wherein the first seal is positioned between the seal post tip and the sheath opening when the seal post is in the sealed position.

3. The bite valve of claim 2, further comprising a biasing member configured to provide a bias between the body and the seal post and to resist movement of the seal post from the sealed position to the unsealed position.

4. The bite valve of claim 3, further comprising a collar attached to the sheath and positioned between the sheath and the seal post, wherein the second seal is positioned between the collar and the seal post when the seal post is in the sealed position.

5. The bite valve of claim 4, wherein the collar comprises a lip seal with an inwardly facing surface, wherein the second seal is positioned between the lip seal and the seal post when the seal post is in the sealed position.

6. The bite valve of claim 5, further comprising an o-ring positioned within a groove extending around the seal post, wherein the biasing member seals the inwardly facing surface against the o-ring when the seal post is in the sealed position.

7. The bite valve of claim 1, wherein the seal post is configured to move longitudinally within the sheath channel between the sealed position and the unsealed position.

8. The bite valve of claim 1, wherein the first seal is positioned within the sheath channel downstream with respect to the second seal.

9. A bite valve for a hydration system, comprising:

a sheath comprising a proximal end, a distal end and a sheath outlet positioned proximate to the distal end;

a body configured to attach to the proximal end of the sheath such that the sheath and the body form a fluid flow channel extending through the body and sheath to the sheath outlet;

a movable seal post positioned within the fluid flow channel, the seal post being movable with respect to the sheath and the body between a sealed position and an unsealed position, wherein the seal post comprises an inclined surface configured such that an approximately transverse force applied against the inclined surface causes the seal post to move from the sealed position to the unsealed position; and a first seal and a second seal formed within the fluid flow channel, wherein the first seal is configured selectively to restrict and to allow fluid flow from a first portion of the fluid flow channel and through the sheath outlet, and wherein the second seal is configured selectively to restrict and to allow flow between the first portion and a second portion of the fluid flow channel, and wherein the inclined surface is positioned between the first and the second seal.

10. The bite valve of claim 9, further comprising a biasing member configured to resist movement of the seal post between the sealed position and the unsealed position with respect to the body and sheath.

11. The bite valve of claim 10, wherein the body and the seal post comprise opposed longitudinally-facing surfaces, the biasing member positioned between and configured to provide a bias between said opposed surfaces, to resist longitudinal movement of the seal post within the fluid flow channel with respect to the sheath and the body.

12. The bite valve of claim 9, wherein the first portion of the fluid flow channel comprises a body flow channel extending through a portion of the body and the second portion of the fluid flow channel comprises a sheath flow channel extending through a portion of the sheath, wherein the sheath flow channel is positioned downstream with respect to the body flow channel.

13. The bite valve of claim 12, wherein the seal post comprises a seal post tip, and wherein the first seal is positioned between the seal post tip and the sheath outlet when the seal post is in the sealed position.

14. The bite valve of claim 12, further comprising a collar attached to the body and positioned between the body and the seal post, wherein the second seal is positioned between the collar and the seal post when the seal post is in the sealed position.

15. The bite valve of claim 14, wherein the collar comprises a collar support configured to attach the collar to the body, wherein the body flow channel comprises a collar flow channel formed between a portion of the collar support and a proximal portion of the seal post.

16. The bite valve of claim 15, wherein the sheath flow channel comprises a valve-post channel formed between a distal portion of the seal post and the sheath.

17. The bite valve of claim 14, wherein the collar comprises a lip seal configured to engage with an o-ring extending around the seal post to form the second seal.

* * * * *

UNITED STATES PATENT AND TRADEMARK OFFICE

CERTIFICATE OF CORRECTION

PATENT NO. : 8,152,138 B2
APPLICATION NO. : 12/322995
DATED : April 10, 2012
INVENTOR(S) : Jeffrey Skillern It is certified that error appears in the above-identified patent and that said Letters Patent is hereby corrected as shown below:

On the Title Page, Line 20 (Approx.), Under Dec. 10, 2009 and before Item (51) Int. Cl., insert
--(60) Related U.S. Application Data
U.S. Provisional Application No. 61/026,961, filed February 7, 2008.--.

On Page 2, (Item 56), Line 4, Under Other Publications, change "prosectuion" to --prosecution--.

On Page 2, (Item 56), Line 5, Under Other Publications, change "prosectuion" to --prosecution--.

On Page 2, (Item 56), Line 9, Under Other Publications, change "prosection" to --prosecution--.

Signed and Sealed this
Sixteenth Day of October, 2012

David J. Kappos

David J. Kappos
*Director of the United States Patent and Trademark Office*